United States Patent [19]

Mayr et al.

[11] Patent Number: 4,538,765

[45] Date of Patent: Sep. 3, 1985

[54] METHOD FOR DEFIBERIZING WASTE PAPER IN A THICK STOCK RANGE

[75] Inventors: Hermann Mayr, Blaustein; Albrecht Kahmann, Weingarten; Gerhard Lambrecht, Fronreute; Wolfgang Heinbockel, Weingarten; Wolfgang Siewert, Ravensburg-Weingartshof; Josef Maier, Wolpertswende, all of Fed. Rep. of Germany

[73] Assignee: Escher Wyss GmbH, Ravensburg/Württ., Fed. Rep. of Germany

[21] Appl. No.: 447,311

[22] Filed: Dec. 6, 1982

[30] Foreign Application Priority Data

Dec. 10, 1981 [CH] Switzerland ..... 7887/81

[51] Int. Cl.[3] ..... B02C 23/36

[52] U.S. Cl. ..... 241/21; 162/55; 162/57; 162/261; 210/213; 210/738; 210/804; 241/41; 241/46.17

[58] Field of Search ..... 241/16, 21, 24, 28, 241/41, 46 R, 46 B, 46.17, 69, 79, 246, 257 R; 210/803, 804, 806, 738, 219, 213, 203; 162/55, 57, 261

[56] References Cited

U.S. PATENT DOCUMENTS

| | | | |
|---|---|---|---|
| 2,309,036 | 1/1943 | Beardsley | 241/41 |
| 3,774,853 | 11/1973 | Seifert | 241/46.17 X |
| 3,925,150 | 12/1975 | Marsh | 162/55 X |
| 4,129,259 | 12/1978 | Vokes | 241/46.17 X |
| 4,397,713 | 8/1983 | Lambrecht | 162/261 |

*Primary Examiner*—Howard N. Goldberg
*Assistant Examiner*—Timothy Eley
*Attorney, Agent, or Firm*—Werner W. Kleeman

[57] ABSTRACT

Waste paper is defiberized within a container or receptacle in a thick stock range at a low water level. Thereafter, by further infeeding water, the obtained slurry or the like is diluted to a consistency of less than 7% while continuing the defiberizing operation. Finally, the obtained stock suspension is withdrawn through a sieve or screen located at the floor of a defiberizing container. The defiberizing container or receptacle used for performing the method possesses a lower region having a smaller diameter, above which there is located an upper region having a larger diameter.

8 Claims, 3 Drawing Figures

METHOD FOR DEFIBERIZING WASTE PAPER IN A THICK STOCK RANGE

BACKGROUND OF THE INVENTION

The present invention relates to a new and improved method of defiberizing waste paper in a thick stock range.

In its more specific aspects the method of the present development serves for the defiberizing of waste paper in a thick stock range having a consistency greater than 10%, the waste paper being defiberized in a defiberizing container or receptacle equipped with a rotor, there being added an appropriate quantity of water and, to the extent desired or needed, possibly chemicals.

It is known in the waste paper processing art that the defiberizing of waste paper in the thick stock range affords certain advantages as concerns a saving in chemicals, thermal energy, and so forth, since such can act in a more concentrated and effective fashion upon a smaller quantity of water. However, following defiberizing there exists the problem of sorting which preferably should be accomplished in the thin stock range.

For this purpose there were heretofore proposed different apparatuses containing sieves or screens—also referred to as wires—located externally of the defiberizing container, and the fiber stock material effluxing from the defiberizing container was diluted in a suitable manner.

SUMMARY OF THE INVENTION

It is a primary object of the present invention to provide a new and improved method of defiberizing waste paper in a thick stock range, wherein the defiberizing operation and the subsequent sieving or screening operation can be accomplished with appreciably simpler means than was heretofore possible, and additionally, there can be attained an enhanced defiberizing of the waste paper.

Now in order to implement these and still further objects of the invention, which will become more readily apparent as the description proceeds, the method of the present development is manifested by the features that, following the defiberizing in the thick stock range the defiberized stock located in the container is diluted by the addition of water so as to have a consistency of less than 7% and is brought into a fluent and pumpable condition, and thereafter the thus obtained thin stock is withdrawn for further use through a sieve or screen located at the lower region of the container. Then, the residues which have not passed through the sieve or screen are withdrawn through a sieve-free opening likewise located at the lower region of the container.

According to the invention the defiberizing in the thick stock range and the dilution together with the subsequent sorting is advantageously accomplished in a single defiberizing container or receptacle, in other words can be accomplished with a minimum expenditure in equipment and operational steps.

It is possible and of particular advantage to have the defiberizing operation further progress during the dilution and following the dilution operation. Consequently, there is obtained a further benefit in that certain defiberizing actions can be accomplished more effectively in the thin stock range than in the thick stock range. In this way there are desirably combined the advantages of both defiberizing techniques or modes.

As already alluded to above, the invention is not only concerned with the aforementioned method aspects, but also relates to a new and improved construction of apparatus for the performance of such method. According to a preferred manifestation of the invention, the defiberizing apparatus for accomplishing the method of the present invention comprises a defiberizing container or receptacle, at the bottom or base region of which there are located a rotor suitable for the defiberizing of waste paper and a sieve or screen plate at which merges a good stock chamber or compartment equipped with an outlet line or outfeed means, and there is also provided a withdrawal line or the like for the residues. The inventive apparatus is specifically manifested by the features that, the defiberizing container has a lower region possessing a smaller diameter and above which there is located an upper region having a larger diameter. In this manner there are obtained optimum operational or working conditions for the rotor and good flow conditions during low liquid level for the thick stock range and during the work in the thin stock range at the higher liquid level.

Preferably, the container or receptacle can possess a lower substantially cylindrical region or portion having a smaller diameter and above which there is located an upper substantially cylindrical region or portion having a larger diameter. Both regions of the container can be interconnected by a widening or diverging transition region or portion which possesses an angle of at most 45° with respect to the lengthwise axis of the defiberizing container. Such construction of defiberizing container can be easily fabricated because it predominantly contains cylindrical parts. However, it should be specifically understood that the defiberizing container also can have a different shape, for instance, can possess a conical outer shell or jacket.

Preferably, the good stock line or the like as well as the withdrawal line or the like for the residues can be equipped with suitable shutoff elements, such as valves, for enabling discontinuous operation of the equipment. These shutoff elements can be preferably provided with an automatic control together with further elements of the equipment, such as for instance infeed lines for water, flushing lines and so forth.

The good stock chamber located beneath the sieve or screen can be connected with a line or conduit or equivalent infeed structure for flushing water. Such beneficially serves for cleaning the sieve or screen and is also useful during the removal of the residues out of the defiberizing container.

At the upper edge or end region of the defiberizing container or receptacle there can be arranged a ring-shaped or annular line or conduit equipped with nozzle openings or the like for flushing the walls of the container. This design renders possible, during operation of the equipment, cleaning of the container from parts or constituents which adhere thereto.

BRIEF DESCRIPTION OF THE DRAWINGS

The invention will be better understood and objects other than those set forth above, will become apparent when consideration is given to the following detailed description thereof. Such description makes reference to the annexed drawings wherein.

DETAILED DESCRIPTION OF THE PREFERRED EMBODIMENTS

Figure 1:
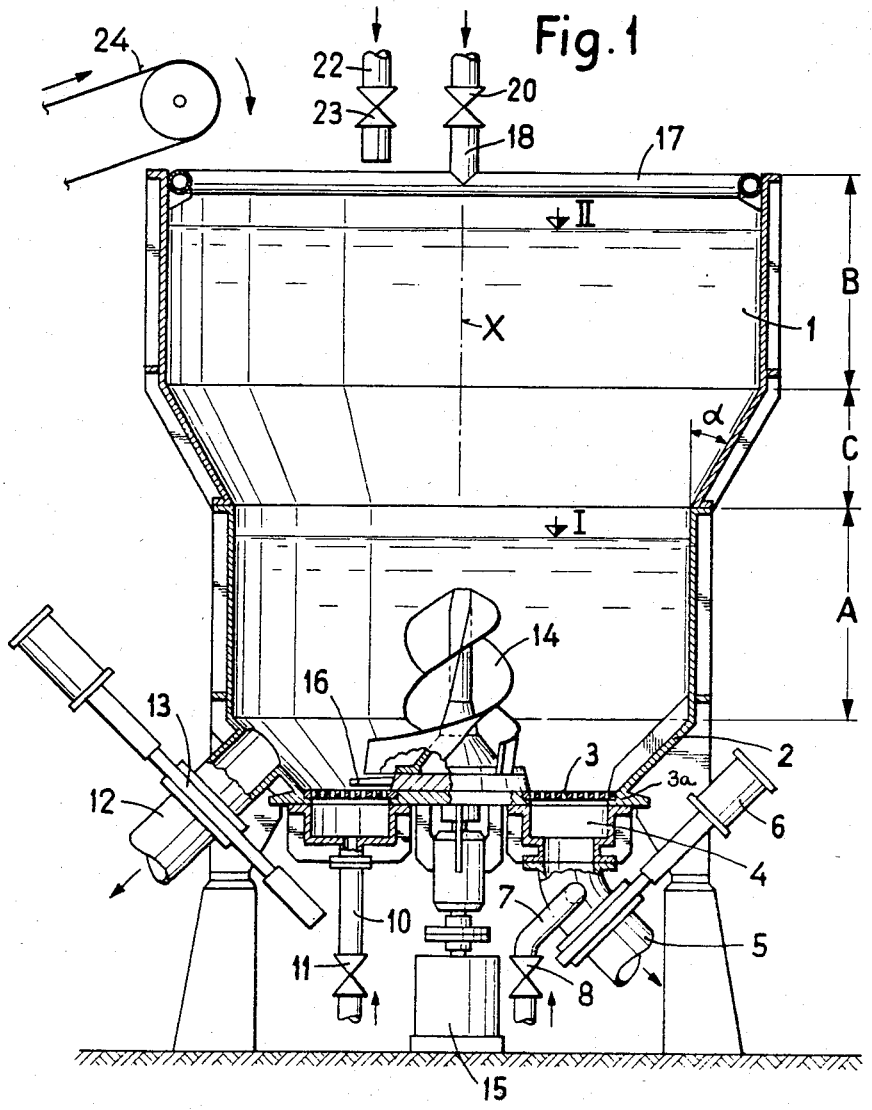
FIG. 1 is a schematic sectional view of a defiberizing apparatus constructed according to the present invention and suitable for performing the method of the present invention.

Describing now the drawings, it is to be understood that only enough of the construction of the waste paper processing equipment has been illustrated therein as will enable those skilled in this art to readily understand the underlying principles and concepts of the present invention, while simplifying the illustration of the drawings. Turning attention now specifically to FIG. 1, the defiberizing apparatus depicted therein by way of example and not limitation, will be seen to comprise a defiberizing container or receptacle 1 in the form of a body of rotation, the outer wall of which has two substantially cylindrical regions or portions, and specifically a lower cylindrical region or portion A having a smaller diameter and an upper cylindrical region or portion B having a larger diameter. Between the container regions or portions A and B there is located a transition region or portion C of substantially conical configuration which, in the embodiment under discussion, encloses an angle $\alpha$ of approximately 30° with respect to the lengthwise axis X of the defiberizing container 1. Beneath the lower cylindrical region A there is located in conventional fashion at the bottom region of the container 1 a lower conical region or portion 2 at which merges a floor or base member 3*a* which is formed by a substantially ring-shaped sieve or screen 3, also referred to as a screen plate. Beneath this screen or screen plate 3 there is likewise located in known manner a good stock chamber or compartment 4 from which outwardly leads an outlet or discharge line 5 having a suitable shutoff element 6 and serving for the outfeed of the good stock.

Merging with the good stock outlet line or conduit 5, forwardly of the shutoff element 6, is a flushing line or conduit 7 containing a suitable shutoff element 8, such as a valve. Opening into the good stock chamber or compartment 4 is a flushing line or conduit 10 or equivalent structure containing a shutoff element 11, again for instance a valve. Leading out of the conical region or portion 2 of the defiberizing container 1 towards the outside is a withdrawal line or conduit 12 for residues, this withdrawal line 12 also being equipped with a suitable shutoff element 13. Located internally of the defiberizing container 1 is a rotor 14 for the defiberizing of the waste paper. This rotor 14 is driven by any suitable electric motor 15. The rotor 14 is equipped with arm members 16 which move over the sieve or screen 3 and in conventional fashion serve for the cleaning thereof during operation of the apparatus.

Figure 2:
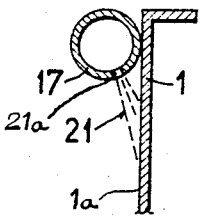
FIG. 2 is an enlarged fragmentary detailed showing of part of the arrangement of FIG. 1.

At the upper edge of the defiberizing container 1 there is located a ring or annular-shaped line or conduit 17 or equivalent facility for the infeed of flushing and dilution water. This ring-shaped line or conduit 17 is connected with a water line or conduit 18 containing a suitable shutoff element 20, such as a valve. As best seen by referring to FIG. 2, the ring or annular-shaped line 17 is provided with nozzles or nozzle openings 21*a*, so that the water jets 21 effluxing therefrom are directed towards the inner surface or internal walls 1*a* of the defiberizing container 1. Additionally, this defiberizing container 1 is provided with a line or conduit 22 for dilution water, this conduit 22 being provided with a suitable shutoff element 23, again for instance a valve. The defiberizing container 1 further is equipped with a suitable transport device 24, here shown for instance in the form of a standard conveyor belt or band, serving for the infeed of bales of paper which are to be defiberized.

Reverting again to FIG. 1, it will be seen that at the defiberizing container 1 there have been also indicated two liquid levels, specifically, the liquid lever I for an approximately 15% stock consistency, and the liquid level II at which, with the same quantity of fiber stock, there exists a consistency of approximately 5%.

Figure 3:
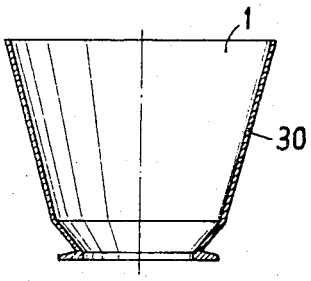
FIG. 3 illustrates a further possible design of the defiberizing container or receptacle.

FIG. 3 illustrates a further possible design of the defiberizing container or receptacle 1, wherein, in this case, there is provided a conical shell or outer jacket having a wall 30.

At the start of the operation the defiberizing container or receptacle 1 is filled with bales of waste paper and with water up to the level I, and by rotating the rotor 14 there is accomplished the defiberizing operation in the thick stock range at, for instance, a 15% fiber stock content.

After the defiberizing of the waste paper and through the further infeed of water up to the higher level II the obtained fiber stock is diluted up to approximately a 5% fiber stock content, so that it becomes fluent or flowable. During the dilution process and also for a certain time following the same the rotor 14 can remain in operation, so that the defiberizing operation can continue in the thin stock range.

Moreover, by opening the shutoff element 6 of the outlet line or conduit 5 it is possible to withdraw the contents of the defiberizing container 1 through the screen or sieve 3 into the good stock chamber or compartment 4 and such contents of the good stock chamber 4 then can be withdrawn from the good stock chamber 4 through the outlet line or conduit 5 where it undergoes a further treatment as it moves to the paper-making machine. After emptying of the defiberizing container 1 of the good stock it is possible to flush the walls 1*a* of the defiberizing container 1 by the action of the nozzles 21*a* of the ring or annular-shaped line or conduit 17 or equivalent structure.

Finally, the shutoff element 6 in the outlet or outfeed line 5 is closed and the shutoff element 13 in the residue withdrawal line 12 is opened. Under the action of the flushing water from the lines 7 and 10 the residues remaining in the defiberizing container 1 are withdrawn therefrom through the line or conduit 12.

While there are shown and described present preferred embodiments of the invention, it is to be distinctly understood that the invention is not limited thereto, but may be otherwise variously embodied and practiced within the scope of the following claims. Accordingly,

What we claim is:

1. In a method of defiberizing waste paper in a thick stock range having a consistency greater than 10%, wherein the waste paper is defiberized in a defiberizing container possessing a rotor under the addition of an appropriate quantity of water and, if desired, chemicals, the improvement which comprises the steps:

defiberizing the waste paper at a consistency greater than 10% in a single defiberizing container;

subsequently diluting the defiberized stock located said single defiberizing container to a consistency of less than 7% through the addition of water and thus placing the stock into a fluent and pumpable state in order to obtain a thin stock;

continuing said step of defiberizing the waste paper in said single defiberizing container during said step of diluting the defiberized stock;

thereafter withdrawing the thus obtained thin stock through a screen located at a lower region of said single defiberizing container for further use of said thin stock; and withdrawing residues which have not penetrated through the screen through a screenless opening located at the lower region of said single defiberizing container.

2. The method as defined in claim 1, further including the steps of:

continuing said step of defiberizing the waste paper in said single defiberizing container during a predetermined interval following said step of diluting the defiberized stock.

3. The method as defined in claim 1, wherein:

there is emplyed as the defiberizing container a single defiberizing container having a bottom regions;

said rotor being provided at the bottom region of said single defiberizing container and serving for the defiberizing of the waste paper;

a screen plate and a good stock chamber located at the bottom region of said single defiberizing container;

said good stock chamber being in flow communication with said screen plate;

outlet means for good stock provided for the good stock chamber;

withdrawal means for residues provided for said single defiberizing container;

a portion of said single defiberizing container located above said screen plate having a lower region possessing a smaller diameter; and an upper region of said single defiberizing container located completely above said lower region possessing a larger diameter than said smaller diameter of said lower region.

4. The method as defined in claim 3, wherein:

said single defiberizing container possesses a substantially cylindrical configuration at said lower region possessing said smaller diameter;

said single defiberizing container possessing a substantially cylindrical configuration at said upper region possessing said larger diameter;

said single defiberizing container possessing a widening transition region for interconnecting both of said lower and upper region of said single defiberizing container with one another; and said transition region enclosing an angle of at most 45° with respect to a lengthwise axis of said single defiberizing container.

5. The method as defined in claim 4, wherein:

said outlet means is provided beneath said screen plate and comprises a good stock line equipped with shutoff means;

said withdrawal means comprising a withdrawal line for the residues leading out of said lower region and equipped with shutoff means; and said shutoff means enabling a discontinuous operation of the defiberizing apparatus.

6. The method as defined in claim 3, wherein:

said outlet means comprises a good stock line equipped with shutoff means;

said withdrawal means comprising a withdrawal line for the residues and equipped with shutoff means; and said shutoff means enabling a discontinuous operation of the defiberizing apparatus.

7. The method as defined in claim 3, further including:

conduit means for flusing water connected with the good stock chamber which is located below the screen plate.

8. The method as defined in claim 3, wherein: said single defiberizing container possesses wall means;

a substantially ring-shaped line located at an upper region of said single defiberizing container; and nozzle opening means porivided for said ring-shaped line for flushing the inner surface of said wall means of said single defiberizing container.

* * * * *